US012440944B2

(12) United States Patent
Genozono

(10) Patent No.: US 12,440,944 B2
(45) Date of Patent: Oct. 14, 2025

(54) GRINDING APPARATUS

(71) Applicant: DISCO CORPORATION, Tokyo (JP)

(72) Inventor: Jiro Genozono, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 422 days.

(21) Appl. No.: 18/053,530

(22) Filed: Nov. 8, 2022

(65) Prior Publication Data

US 2023/0158639 A1 May 25, 2023

(30) Foreign Application Priority Data

Nov. 25, 2021 (JP) ..... 2021-191047

(51) Int. Cl.
*B24D 7/06* (2006.01)
*B24B 7/22* (2006.01)
*B24D 7/16* (2006.01)

(52) U.S. Cl.
CPC ..... *B24D 7/066* (2013.01); *B24B 7/228* (2013.01); *B24D 7/16* (2013.01)

(58) Field of Classification Search
CPC . B24D 7/066; B24D 7/16; B24D 7/00; B24D 7/06; B24D 7/08; B24B 7/228; B24B 7/04; B24B 45/003; B24B 45/00–006; B24B 27/0076; B24B 41/068; B24B 41/002; B24B 41/044; B24B 41/047; B24B 47/12; B24B 37/04; H01L 21/67092
USPC ..... 451/278, 548
See application file for complete search history.

(56) References Cited

U.S. PATENT DOCUMENTS 5,899,648 A * 5/1999 Kanaan ..... F16B 31/02 411/432
2006/0178098 A1* 8/2006 Sato ..... B28D 5/022 451/359
2009/0179368 A1* 7/2009 Haimer ..... B23B 31/40 408/239 R
2020/0150038 A1* 5/2020 Ito ..... G01N 21/64

FOREIGN PATENT DOCUMENTS

JP 2019202399 A 11/2019
JP 2021112781 A 8/2021
WO WO-2020084379 A1 * 4/2020

* cited by examiner

*Primary Examiner* — David S Posigian
*Assistant Examiner* — Michael A Gump
(74) *Attorney, Agent, or Firm* — Greer, Burns & Crain, Ltd

(57) ABSTRACT

A grinding apparatus has a grinding wheel fastened to a mount disk connected a spindle by a plurality of bolts. The mount disk has at least three threaded holes and a plurality of protrusions protruding from a mount surface thereof. Each of the bolts includes an externally threaded shank, a neck coupled to the externally threaded shank, and an engaging flange coupled to the neck and extending radially outwardly. The grinding wheel includes an annular open hole defined in a mating surface of an annular base for mating with the mount surface, an annular slot that is wider than the annular open hole and is fluidly connected to the annular open hole, at least three insertion holes in the annular open hole for allowing the engaging flange to be inserted into the annular slot, and a plurality of protrusion insertion holes for receiving the engaging flanges of the bolts.

3 Claims, 5 Drawing Sheets

GRINDING APPARATUS

BACKGROUND OF THE INVENTION

Field of the Invention

The present invention relates to a grinding apparatus including a grinding wheel that has a plurality of grindstones arranged in an annular array.

Description of the Related Art

A grinding apparatus for grinding various plate-shaped workpieces such as semiconductor wafers includes a mount disk disposed on the distal end of a spindle and a grinding wheel mounted on the mount disk. A plurality of grindstones are arranged in an annular array on the lower surface of an annular base of the grinding wheel. When the spindle is rotated about its central axis, the grindstones are rotated to grind a workpiece that is held in abrasive contact with the grindstones. When the grindstones are worn beyond a certain limit, the grinding wheel needs to be replaced with a fresh one. There has been proposed in the art a mechanism for facilitating the replacement of unduly worn grinding wheels.

For example, JP 2019-202399A discloses a grinding apparatus including a base disposed on a spindle and having a plurality of first chuck claws and a second chuck claw for supporting a grinding wheel on a wheel mount. The grinding wheel is supported on the wheel mount by wedge engagement with the first and second chuck claws. Therefore, a complex fastening process such as screw tightening is not required to support the grinding wheel on the wheel mount. JP 2021-112781A reveals a grinding apparatus including a grinding unit that has a wheel engaging member mounted on the lower end of a spindle. When the wheel engaging member is moved toward a grinding wheel that is placed on a chuck table until the wheel engaging member engages the grinding wheel, the grinding wheel is mounted on the spindle by the wheel engaging member.

SUMMARY OF THE INVENTION

In order for a grinding apparatus to incorporate the mechanism disclosed in JP 2019-202399A or JP 2021-112781A, however, the grinding apparatus need to have a modified mount disk on the distal end of the spindle. In addition, a motor controller that controls an electric motor for rotating the spindle is required to change its settings based on the mount disk that has become heavier due to its modification. It is time-consuming to modify the mount disk and change the settings of the motor controller. Moreover, the spindle on which the mount disk is mounted may need to be replaced in some cases.

It is therefore an object of the present invention to provide a grinding apparatus including a grinding wheel mounted on the distal end of a spindle by a mount disk that has been modified in a short period of time from an existing structure for allowing the grinding wheel to be replaced easily.

In accordance with an aspect of the present invention, there is provided a grinding apparatus for grinding a workpiece, including a chuck table for holding the workpiece thereon, a spindle rotatable about a central axis thereof, a mount disk connected to a distal end of the spindle and having a mount surface, and a grinding wheel having an annular base having a mating surface for mating with the mount surface of the mount disk and a plurality of grindstones fixed in an annular array to the annular base, the grinding wheel being fastened to the mount disk by a plurality of bolts, in which the mount disk has at least three internally threaded holes defined therein at equal spaced intervals circumferentially thereon and extending therethrough between upper and lower surfaces thereof, and a plurality of protrusions protruding from the mount surface, each of the bolts includes an externally threaded shank, a neck coupled to a distal end of the externally threaded shank, and an engaging flange coupled to a distal end of the neck and extending radially outwardly from the neck, the grinding wheel includes an annular open hole defined in the mating surface, an annular slot defined in the annular base that is wider than the annular open hole and vertically fluidly connected to the annular open hole, at least three insertion holes defined in the annular open hole for allowing the engaging flange to be inserted therethrough into the annular slot, and a plurality of protrusion insertion holes defined in the annular open hole for receiving the engaging flanges of the bolts therein, and, for mounting the grinding wheel on the mount disk, the externally threaded shanks of the bolts are threaded into the internally threaded holes in the mount disk, with the engaging flanges projecting from the mount surface, after the engaging flanges are inserted from the insertion holes into the annular slot, the mount disk and the grinding wheel are rotated relatively to each other, and when the protrusion insertion holes and the protrusions are positionally aligned with each other, the bolts are rotated to insert the protrusions into the protrusion insertion holes and to fasten the mount disk and the grinding wheel to each other with the bolts.

Preferably, the insertion holes double as the protrusion insertion holes.

Preferably, the protrusions, the engaging flanges, the insertion holes, and the protrusion insertion holes are cylindrical in shape.

According to the present invention, inasmuch as the grinding wheel can easily be replaced with a fresh one without the need for a complex mechanism on the mount disk, the mount disk is prevented from becoming heavier. Consequently, it is not necessary to change the settings of a motor controller for controlling the electric motor for rotating the spindle. In addition, as there is no need for the mount disk to hold the grinding wheel under suction forces, the mount disk does not need to be fluidly connected to a suction source, and hence the spindle does not need to be replaced.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
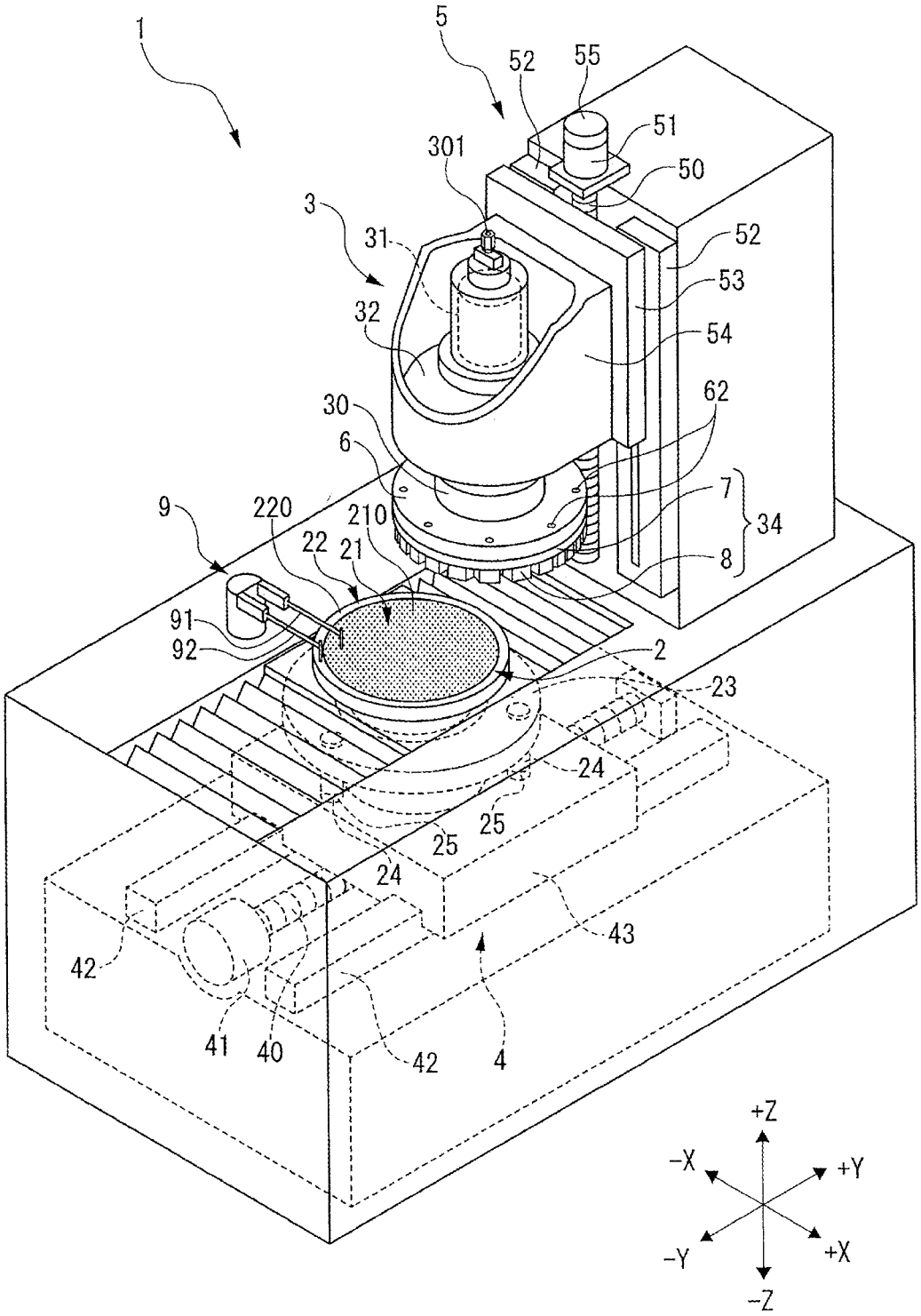
FIG. 1 is a perspective view of a grinding apparatus according to an embodiment of the present invention.

FIG. 1 illustrates in perspective a grinding apparatus 1 according to an embodiment of the present invention. In FIG. 1, the grinding apparatus 1 is illustrated in reference to a three-dimensional coordinate system having X-, Y-, and Z-axes indicated respectively by the arrows +X and −X, +Y and −Y, and +Z and −Z. The X-axis and the Y-axis lie on a horizontal plane, whereas the Z-axis extends vertically perpendicularly to the horizontal plane.

The grinding apparatus 1 is an apparatus for grinding a workpiece, not illustrated, typically a semiconductor wafer, held on a chuck table 2 with a grinding mechanism 3. The chuck table 2 is horizontally movable along the Y-axis by a moving mechanism 4, and the grinding mechanism 3 is vertically movable along the Z-axis by a grinding feed mechanism 5.

The chuck table 2 includes a suction member 21 made of a porous material and a frame 22 supporting the suction member 21 thereon. The suction member 21 has an upper surface acting as a holding surface 210 for holding the workpiece under suction thereon. The holding surface 210 and an upper surface 220 of the frame 22 that surrounds the suction member 21 lie flush with each other.

The grinding apparatus 1 includes a table base 23 disposed below the chuck table 2 and supporting the chuck table 2 thereon. The table base 23 has at least three lower surface areas supported by respective three chuck support legs 24 (only two of them are illustrated in FIG. 1) disposed therebelow. The chuck support legs 24 are combined respectively with load measuring units 25 for measuring vertical loads that are applied when the grinding mechanism 3 presses the workpiece held on the holding surface 210. At least two of the chuck support legs 24 have a function to adjust the tilt of the holding surface 210 by adjusting the height of the chuck table 2.

The grinding mechanism 3 includes a vertical spindle 30 rotatable about a rotational axis extending along the Z-axis, an electric motor 31 for rotating the spindle 30, a spindle housing 32 in which the spindle 30 is rotatably supported, a mount disk 6 coupled to the lower end of the spindle 30, and a grinding wheel 34 mounted on the lower surface of the mount disk 6. The spindle 30 has a grinding fluid inlet port 301 defined in the upper end thereof for introducing a grinding fluid into the spindle 30. When the electric motor 31 is energized, it rotates the spindle 30 about its rotational axis, thereby rotating the grinding wheel 34 about its vertical central axis. The grinding wheel 34 includes an annular base 7 fixed to the lower surface of the mount disk 6 and a plurality of grindstones 8 fixed in an annular array to the lower surface of the annular base 7.

The moving mechanism 4 includes a horizontal ball screw 40 rotatable about a rotational axis extending along the Y-axis, an electric motor 41 for rotating the ball screw 40, a pair of guide rails 42 disposed one on each side of the ball screw 40 and extending parallel to the ball screw 40, and a slide plate 43 having bottom surfaces held in slidable contact with the respective guide rails 42 and having a nut, not illustrated, on its lower surface that is operatively threaded over the ball screw 40. The slide plate 43 has an upper surface supporting thereon the chuck support legs 24 and the load measuring units 25. When the electric motor 41 is energized, it rotates the ball screw 40, causing the nut to move the slide plate 43 along the Y-axis along the guide rails 42. When the slide plate 43 is moved along the Y-axis, the chuck table 2 supported on the slide plate 43 is also moved in unison therewith along the Y-axis.

The grinding feed mechanism 5 includes a vertical ball screw 50 rotatable about a rotational axis extending along the Z-axis, an electric motor 51 for rotating the ball screw 50, a pair of guide rails 52 disposed one on each side of the ball screw 50 and extending parallel to the ball screw 50, a vertically movable plate 53 having side surfaces held in slidable contact with respective the guide rails 52 and having a nut, not illustrated, on its rear surface that is operatively threaded over the ball screw 50, and a holder 54 coupled to the vertically movable plate 53 and supporting the spindle housing 32 on its front surface. When the electric motor 51 is energized, it rotates the ball screw 50, causing the nut to move the vertically movable plate 53 along the Z-axis along the guide rails 52 perpendicularly to the holding surface 210. When the vertically movable plate 53 is moved along the Z-axis, the grinding mechanism 3 is also moved in unison therewith along the Z-axis, moving the grindstones 8 toward or away from the holding surface 210 along the Z-axis. The position of the grinding mechanism 3 along the Z-axis is recognized by an encoder 55 that is combined with the electric motor 51.

A thickness measuring unit 9 for measuring the thickness of the workpiece held on the chuck table 2 is disposed on one side of the track in which the chuck table 2 is movable along the Y-axis. The thickness measuring unit 9 includes a first measuring unit 91 for measuring the height of the upper surface of the workpiece on the holding surface 210 of the suction member 21 and a second measuring unit 92 for measuring the height of the upper surface 220 of the frame 22. The thickness measuring unit 9 measures the difference between a measured value from the first measuring unit 91 and a measured value of the second measuring unit 92 as the thickness of the workpiece.

Figure 2:
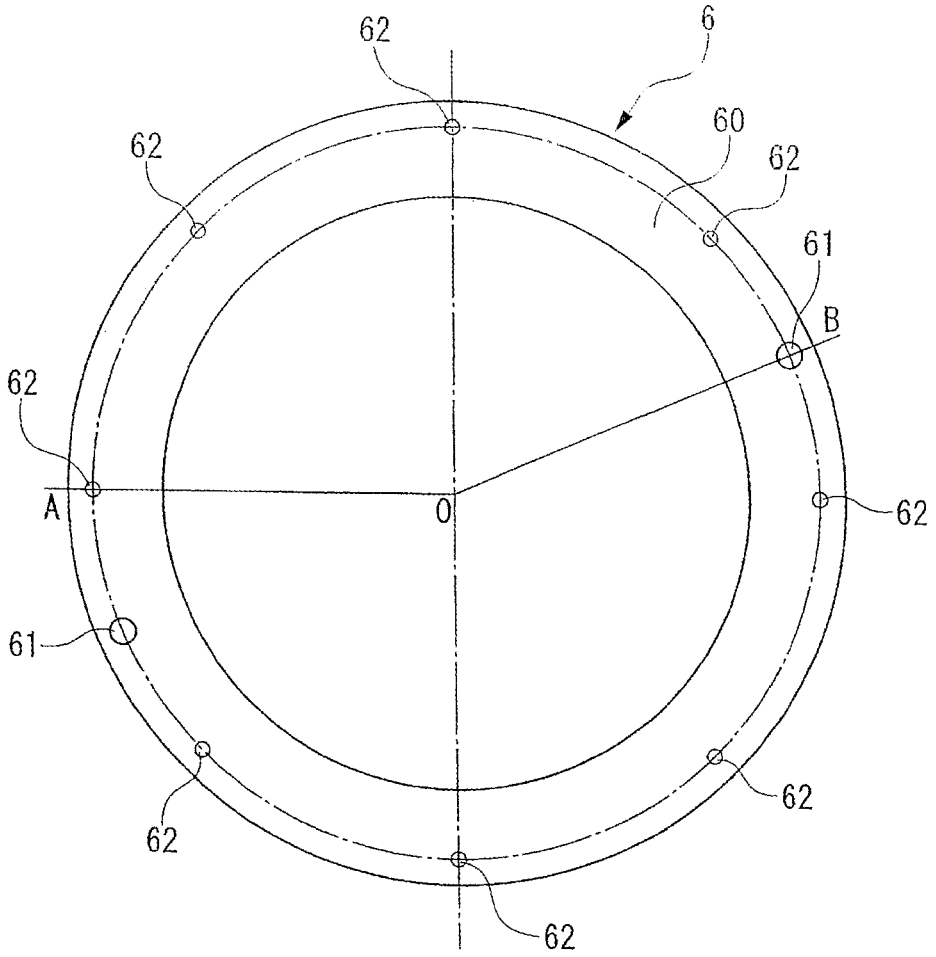
FIG. 2 is a bottom view of a mount disk of the grinding apparatus.

As illustrated in FIG. 2, the mount disk 6 is of an annular shape. The mount disk 6 has a lower surface as a mount surface 60 on which the grinding wheel 34 is mounted. The mount surface 60 has two cylindrical protrusions 61 protruding downwardly. The two protrusions 61 are disposed circumferentially on a common circle on the mount disk 6 in diametrically opposite relation to each other, i.e., angularly spaced from each other by 180 degrees around the center O of the mount disk 6.

The protrusions 61 may be integral with the mount disk 6 or may be separate from and detachably mounted on the mount disk 6. If the protrusions 61 are separate from and detachably mounted on the mount disk 6, then they may have externally threaded distal ends threaded in respective internally threaded recesses defined in the mount surface 60 of the mount disk 6. The protrusions 61 may be located in different positions on the mount disk 6 depending on the type of the grinding wheel 34 or may be of a polygonal shape depending on the type of the grinding wheel 34.

Figure 3:
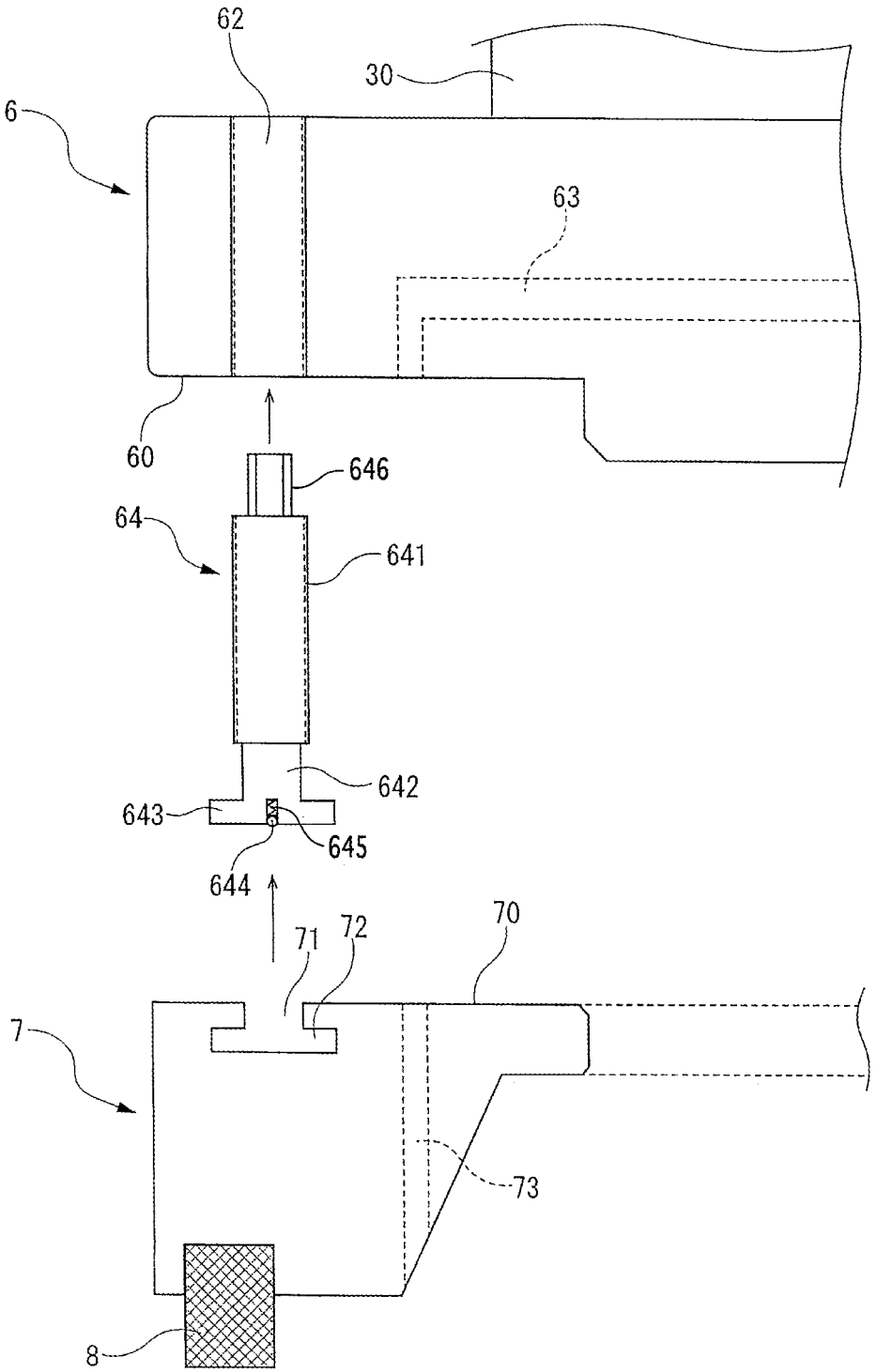
FIG. 3 is an enlarged fragmentary cross-sectional view of the mount disk, a bolt, and a grinding wheel.

The mount disk 6 has eight internally threaded holes 62 defined therein at equal spaced intervals on the common circle on which the protrusions 61 are disposed. Though the mount disk 6 is illustrated as having eight internally threaded holes 62 in FIG. 2, the mount disk 6 may have at least three internally threaded holes 62. As illustrated in FIG. 3, each of the internally threaded holes 62 extends axially through the mount disk 6 between its upper and lower surfaces. The mount disk 6 also has a grinding fluid channel 63 defined therein through which the grinding fluid introduced from the grinding fluid inlet port 301 into the spindle 30 and flowing through a fluid channel, not illustrated, defined in the spindle 30 flows into the mount disk 6.

As illustrated in FIG. 3, a bolt 64 is threaded into each of the internally threaded holes 62. The bolt 64 has an externally threaded shank 641, a neck 642 coupled to a distal end of the externally threaded shank 641, and a cylindrical engaging flange 643 coupled to a distal end of the neck 642 and extending radially outwardly from the neck 642, the cylindrical engaging flange 643 being larger in diameter than the neck 642. The bolt 64 includes a plunger 644 disposed in a cavity defined in the distal end of the neck 642 and normally biased to project axially in a direction out of the cavity by a spring 645 disposed in the cavity. The bolt 64 includes a hexagon head bolt having an engaging portion 646 disposed adjacent to the externally threaded shank 641 remotely from the neck 642 for engagement with a hexagonal wrench.

Figure 4:
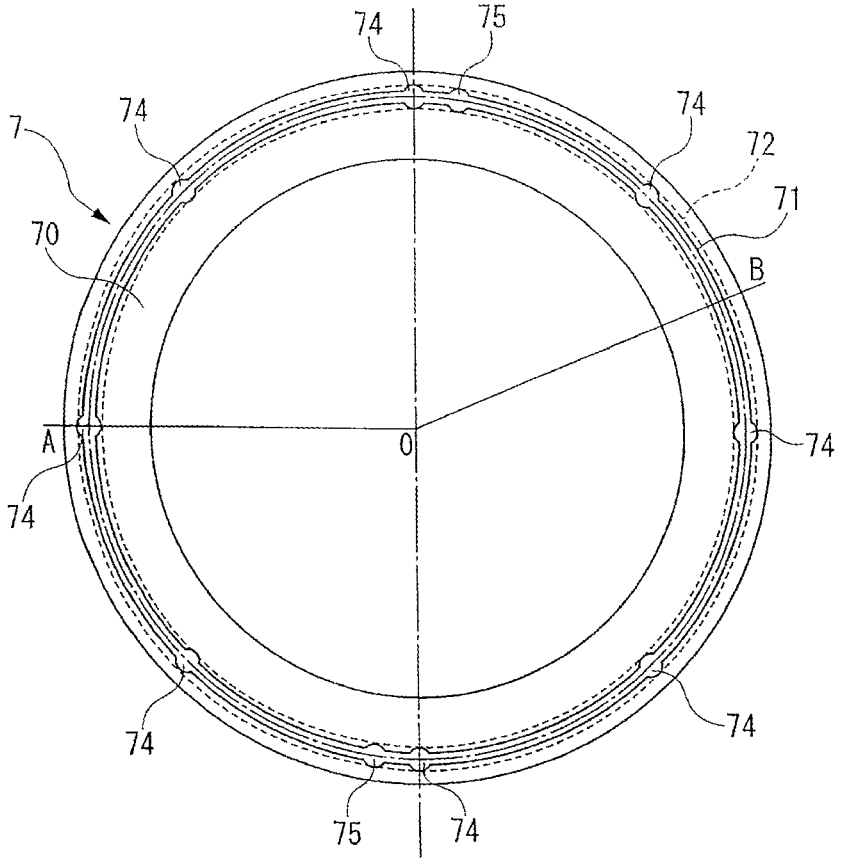
FIG. 4 is a plan view of an annular base of the grinding wheel.
Figure 5:
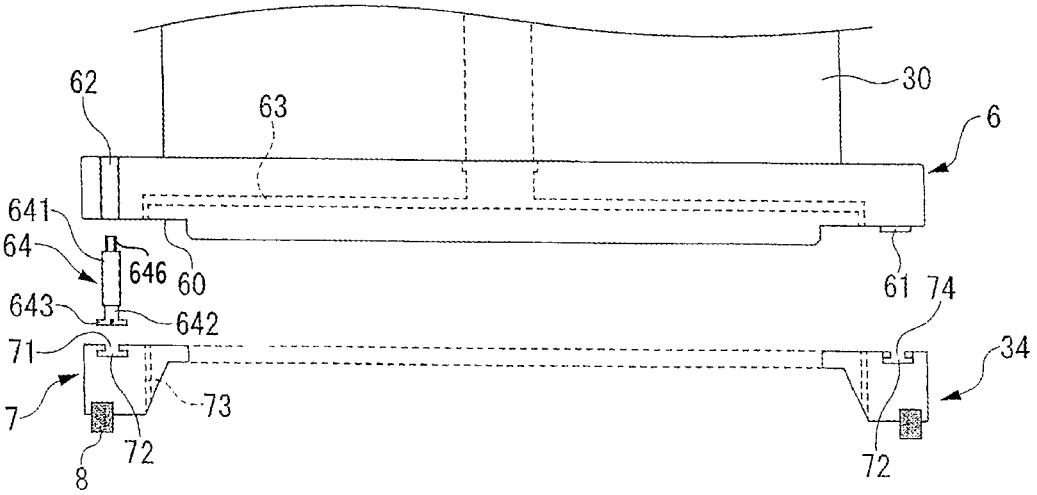
FIG. 5 is a cross-sectional view illustrating the manner in which a bolt is to be inserted into an internally threaded hole in the mount disk.

As illustrated in FIG. 4, the annular base 7 of the grinding wheel 34 has an upper surface as a mating surface 70 for mating with the mount surface 60 of the mount disk 6. The mating surface 70 has an annular open hole 71 defined therein. As illustrated in FIG. 5, the annular base 7 has a bottomed annular slot 72 defined therein that is wider than the annular open hole 71 and vertically fluidly connected to the annular open hole 71. The annular base 7 also has grinding fluid ejection passages 73 defined therein that have upwardly open upper ends fluidly connected to the grinding fluid channel 63 in the mount disk 6 and downwardly open lower ends.

As illustrated in FIG. 4, the annular open hole 71 includes a plurality of cylindrical insertion holes 74 angularly spaced at equal intervals. The cylindrical insertion holes 74 are capable of receiving the respective cylindrical engaging flanges 643 of the bolts 64, i.e., are slightly larger in diameter than the cylindrical engaging flanges 643 of the bolts 64. Though the annular open hole 71 is illustrated as including eight cylindrical insertion holes 74 in FIG. 4, the annular open hole 71 may include at least three cylindrical insertion holes 74.

The annular open hole 71 also includes a plurality of protrusion insertion holes 75, which are formed at equal intervals, for receiving therein the protrusions 61 of the mount disk 6. The annular open hole 71 includes as many protrusion insertion holes 75 as the number of the protrusions 61. Since the two protrusions 61 are angularly spaced from each other by 180 degrees in FIG. 2, there are also two protrusion insertion holes 75 angularly spaced from each other by 180 degrees.

Figure 6:
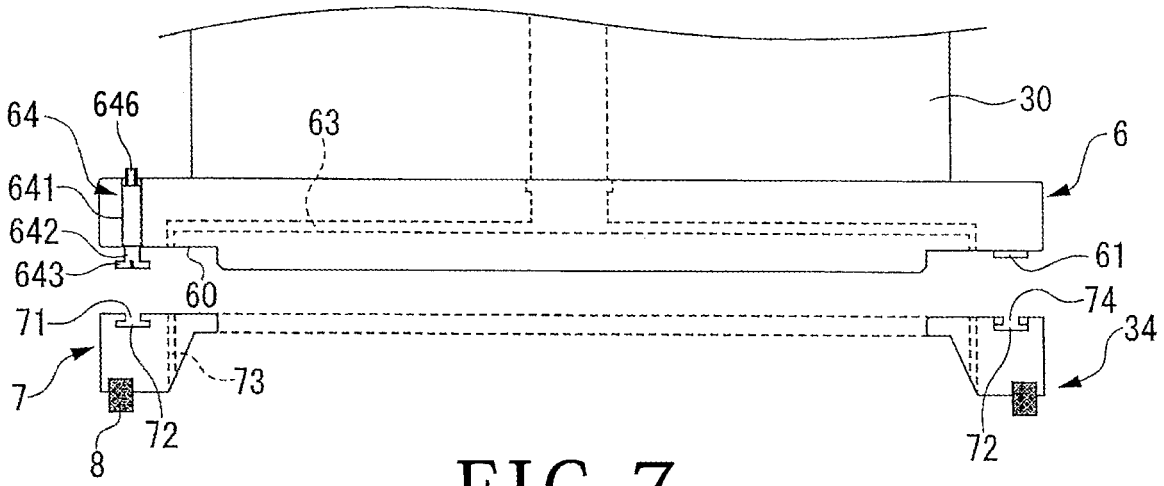
FIG. 6 is a cross-sectional view illustrating the manner in which the bolt has been inserted into the internally threaded hole in the mount disk.
Figure 7:
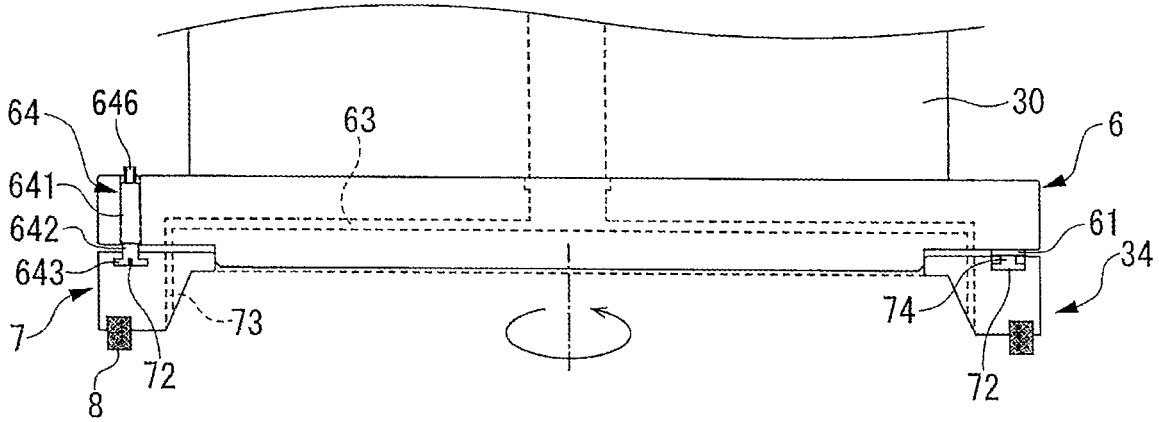
FIG. 7 is a cross-sectional view illustrating the manner in which an engaging flange of the bolt has engaged in an annular slot defined in the annular base and the mount disk and the grinding wheel are rotated relatively to each other.

A process of mounting the annular base 7 of the grinding wheel 34 on the mount disk 6 will be described below with reference to FIGS. 5 through 8. The mount disk 6 illustrated in cross section in FIG. 5 is taken along line A-O-B of FIG. 2. The grinding wheel 34 illustrated in cross section in FIGS. 5 and 6 is taken along line A-O-B of FIG. 4.

First, as illustrated in FIG. 5, the operator threads the externally threaded shanks 641 of the bolts 64 into the respective internally threaded holes 62 in the mount disk 6, with the cylindrical engaging flanges 643 projecting downwardly from the mount surface 60. Then, the operator inserts the cylindrical engaging flanges 643 into the respective cylindrical insertion holes 74 illustrated in FIG. 4, thereby inserting the cylindrical engaging flanges 643 into the bottomed annular slot 72 to the full depth thereof. With the cylindrical engaging flanges 643 inserted in the bottomed annular slot 72, the operator rotates the mount disk 6 and the grinding wheel 34 relatively to each other.

The relative rotation of the mount disk 6 and the grinding wheel 34 causes the necks 642 to enter the annular open hole 71 and also causes the cylindrical engaging flanges 643 to enter and engage in the bottomed annular slot 72. The mount disk 6 and the grinding wheel 34 are continuously rotated relatively to each other until the protrusion insertion holes 75 defined in the annular base 7 and the cylindrical protrusions 61 of the mount disk 6 are positionally aligned with each other. The bottomed annular slot 72 should preferably include a plurality of recesses, not illustrated, defined in the bottom thereof for receiving respective distal ends of the plungers 644 at the time when the protrusion insertion holes 75 and the cylindrical protrusions 61 are positionally aligned with each other. During the relative rotation of the mount disk 6 and the grinding wheel 34, the plungers 644 that are normally biased to project axially in the direction out of the cavities by the springs 645 have their distal ends pressed against the bottom of the annular slot 72. Therefore, the mount disk 6 and the grinding wheel 34 are prevented from rotating freely relatively to each other.

Figure 8:
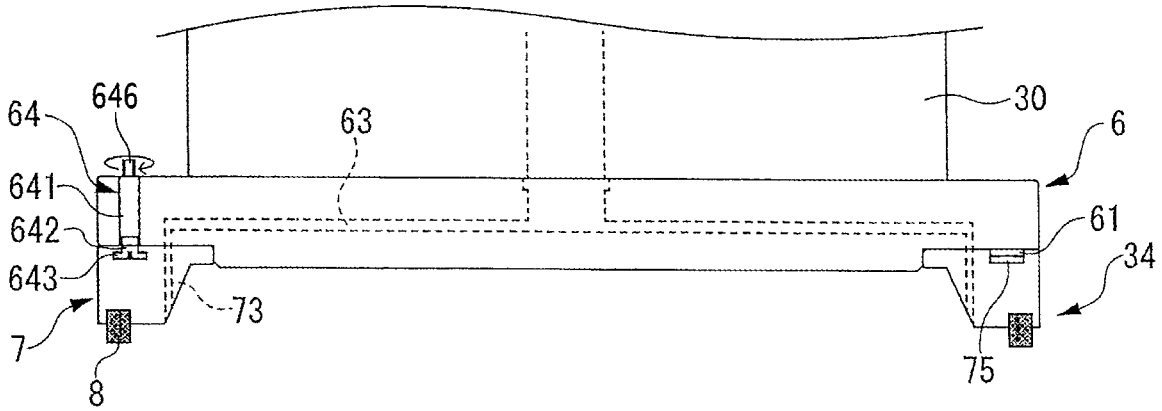
FIG. 8 is a cross-sectional view illustrating the manner in which a protrusion on the mount disk is inserted in a protrusion insertion hole in the annular base and the mount disk and the grinding wheel are fastened together by the bolt.

When the protrusion insertion holes 75 and the cylindrical protrusions 61 are positionally aligned with each other, the operator brings the mount disk 6 and the grinding wheel 34 to a halt against relative rotation. Then, as illustrated in FIG. 8, the operator applies a hexagonal wrench successively to the engaging portions 646 of the bolts 64 and turns the hexagonal wrench to rotate the bolts 64 in the respective internally threaded holes 62, bringing the mount disk 6 and the annular base 7 toward each other and into intimate contact with each other. The cylindrical protrusions 61 are now inserted into the respective protrusion insertion holes 75. The bolts 64 are tightened to fasten the mount disk 6 and the annular base 7 of the grinding wheel 34 to each other.

The grinding wheel 34 is thus mounted on the mount disk 6 by causing the cylindrical engaging flanges 643 of the bolts 64 inserted in the respective internally threaded holes 62 in the mount disk 6 to engage in the bottomed annular slot 72 in the annular base 7, rotating the annular base 7 and the mount disk 6 relatively to each other, and tightening the bolts 64 when the protrusion insertion holes 75 and the cylindrical protrusions 61 are positionally aligned with each other. The grinding wheel 34 can be removed from the mount disk 6 by loosening the bolts 64, rotating the annular base 7 and the mount disk 6 relatively to each other, and pulling the cylindrical engaging flanges 643 from the corresponding cylindrical insertion holes 74.

The bottomed annular slot 72 may include recesses for receiving the distal ends of the plungers 644, defined in its bottom at the centers of the respective cylindrical insertion holes 74. Since the spring-loaded plungers 644 snap into the recess at the centers of the respective cylindrical insertion holes 74 when the bolts 64 are aligned with the respective cylindrical insertion holes 74, the operator knows when the grinding wheel 34 has reached the angular position with respect to the mount disk 6 where the grinding wheel 34 can be detached from the mount disk 6.

According to the illustrated embodiment, inasmuch as the grinding wheel 34 can easily be replaced with a fresh one without the need for a complex mechanism on the mount disk 6, the mount disk 6 is prevented from becoming heavier. Consequently, it is not necessary to change the settings of a motor controller for controlling the electric motor 31 for rotating the spindle 30. In addition, as there is no need for the mount disk 6 to hold the grinding wheel 34 under suction forces, the mount disk 6 does not need to be fluidly connected to a suction source, and hence the spindle 30 does not need to be replaced.

The annular base 7 according to the present embodiment has the insertion holes 74 and the protrusion insertion holes 75 separately from each other. However, the insertion holes 74 may double as the protrusion insertion holes 75.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus for grinding a workpiece, comprising:

a chuck table for holding the workpiece thereon;

a spindle rotatable about a central axis thereof;

a mount disk connected to a distal end of the spindle and having a mount surface; and a grinding wheel having an annular base having a mating surface for mating with the mount surface of the mount disk and a plurality of grindstones fixed in an annular array to the annular base, the grinding wheel being fastened to the mount disk by a plurality of bolts, wherein the mount disk has at least three internally threaded holes defined through the mount disk at equal spaced intervals circumferentially on the mount disk and extending through the mount disk between upper and lower surfaces of the mount disk, and a plurality of protrusions protruding from the mount surface, each bolt of the plurality of bolts includes an externally threaded shank, a neck coupled to a distal end of the respective externally threaded shank, and an engaging flange coupled to a distal end of the respective neck and extending radially outwardly from the respective neck, the grinding wheel includes an annular open hole defined in the mating surface, an annular slot defined in the annular base that is wider than the annular open hole and vertically fluidly connected to the annular open hole, at least three insertion holes defined in the annular open hole for allowing a respective engaging flange of each of the plurality of bolts to be inserted through a respective insertion hole of the at least three insertion holes into the annular slot, and a plurality of protrusion insertion holes defined in the annular open hole for receiving the plurality of protrusions therein, respectively, and, for mounting the grinding wheel on the mount disk, each of the externally threaded shanks of the plurality of bolts are configured to be threaded into a respective internally threaded hole of the internally threaded holes in the mount disk, with the respective engaging flanges projecting from the mount surface, and after the respective engaging flanges are inserted from the respective insertion holes into the annular slot, the mount disk and the grinding wheel are configured to be rotated relatively to each other, and when the protrusion insertion holes and the protrusions are positionally aligned with each other, respectively, the bolts are configured to be respectively rotated to insert the protrusions into the protrusion insertion holes, respectively, to fasten the mount disk and the grinding wheel to each other with the plurality of bolts.

2. The grinding apparatus according to claim 1, wherein the insertion holes double as the protrusion insertion holes.

3. The grinding apparatus according to claim 1, wherein the protrusions, the engaging flanges, the insertion holes, and the protrusion insertion holes are cylindrical in shape.

* * * * *